United States Patent [19]

Simon

[11] Patent Number: 4,967,991

[45] Date of Patent: Nov. 6, 1990

[54] ADJUSTABLE CURTAIN SUPPORT SYSTEM

[75] Inventor: Terry L. Simon, Rockford, Ill.

[73] Assignee: Newell Co., Freeport, Ill.

[21] Appl. No.: 392,006

[22] Filed: Aug. 10, 1989

[51] Int. Cl.[5] ..... A47H 1/10

[52] U.S. Cl. ..... 248/265; 248/256; 248/269

[58] Field of Search ..... 248/265, 264, 263, 262, 248/261, 251, 256, 259, 253, 269, 270, 257; 160/330, 345, 903; 211/105.1

[56] References Cited

U.S. PATENT DOCUMENTS

| | | | |
|---|---|---|---|
| 2,913,212 | 11/1959 | Bell | 160/345 X |
| 3,567,261 | 3/1971 | Akczinski | 248/265 X |
| 3,730,469 | 5/1973 | Shields | 248/270 |
| 3,734,440 | 5/1973 | Hoare | 248/265 |
| 4,289,290 | 9/1981 | Miller | 248/251 |
| 4,824,062 | 4/1989 | Wagner | 211/105.1 X |

*Primary Examiner*—Ramon O. Ramirez

*Attorney, Agent, or Firm*—James G. Staples; David I. Roche

[57] ABSTRACT

A curtain support system having a wall mounted bracket which has an outwardly extending bracket arm, and a mating curtain rod arm connected to or integral with a curtain rod. The rod arm and bracket arm are capable of being adjusted so that the curtain rod can assume positions which vary in distance from the supporting wall or window to which the bracket arm is attached. The bracket arm has a rack comprised of a series of slots formed on the upper edge thereof, and the rod arm has a bar which fits into each of the slots in the bracket arm. The bar, which is located along the top edge of the rod arm, cooperates with a stop on the lower edge of the rod arm to allow upward rotation of the rod arm, while limiting downward rotation. The bracket arm and rod arm have complementary interfitting C-shaped cross-sections which provide lateral stability to the system.

14 Claims, 2 Drawing Sheets

ADJUSTABLE CURTAIN SUPPORT SYSTEM

BACKGROUND AND SUMMARY OF THE INVENTION

The present invention relates to a support for curtains. In particular, the invention relates to curtain rods in which the position of the rod can be adjusted relative to the wall to which it is attached.

Devices for use in decorative window treatments include a wide variety of products. A common curtain rod design is one in which a tubular or partially tubular C-shaped rod is comprised of two telescopically engaged sections. One end of each section is bent at 90° to engage a bracket mounted to a wall. The connection between the mounting bracket and the bent rod end generally includes a positive mechanical engagement which prevents slippage in a direction away from the wall.

Depending upon style, complexity, curtain texture and other factors relating to a window treatment design, it is necessary to place a curtain rod at varying distances from the wall to which it is attached. Examples of situations where variability in such distance is required include treatments where two tiers of curtains are used and one curtain (usually the upper curtain) is intended to over-hang another (usually the lower) curtain. Other examples of situations where lateral or outward extension of a curtain support is required include situations where a valance is placed behind or in front of a curtain which is placed at the same height as the valance. Yet another example where relative lateral spacing of curtain rods is required is where criss-cross curtains hang from the same elevation with respect to a window.

All of the above described situations require that there be differential in the distance between the window and each of the two curtain rods used. The extent of the differential will depend upon the material used and the extent to which the curtains are shirred or gathered. Other factors affecting the distance at which a curtain rod should extend from a supporting structure include the position of associated shades and the size and style of woodwork on the window.

Prior art methods of providing a curtain rod with adjustability in a direction perpendicular to the plane of the window have included a telescopic connection, similar to the typical longitudinal telescopic connection of C-shaped curtain rods. However, in order to prevent unwanted movement, such systems have included a set screw to fix the position of the rod relative to the supporting bracket. Such systems are unsatisfactory because they require additional parts, threading of such parts, and the use of hand tools. Furthermore, the set screw in such systems is not easily accessible.

Therefore, it is an object of the present invention to provide a curtain support system in which the position of the rod relative to the supporting structure can be easily adjusted.

Another object of the present invention is to provide a curtain support system in which the number of parts is minimized.

Still a further object of the present invention is to provide a curtain support system in which the degree of adjustability is maximized.

A further object of the invention is to provide a curtain support system which is laterally adjustable without the aid of hand tools.

Yet another object of the invention is to provide a curtain support system which provides a designer with a high degree of flexibility in design.

These and other objects of the invention are achieved with a curtain support system in which a wall mountable bracket has an outwardly extending arm. A curtain rod which has an inwardly extending rod arm is shaped to closely fit over the bracket arm. The bracket arm includes a plurality of slots on the top edge of the bracket arm. The slots extend in a direction perpendicular to the bracket arm (parallel to the curtain rod), and the slots are shaped to engage a bar formed on the upper edge of the inwardly extending rod arm. The bottom edge of the rod arm includes an opening so that the arms may be tilted with respect to each other without being completely disengaged. The rod arm further includes a stop which limits the downward rotation of the rod arm by engaging the lower edge of the bracket arm.

BRIEF DESCRIPTION OF THE DRAWINGS

The objects and advantages of the invention will be better understood upon a reading of the following specification read in conjunction with the accompanying drawings wherein.

DETAILED DESCRIPTION OF THE INVENTION

Figure 1:
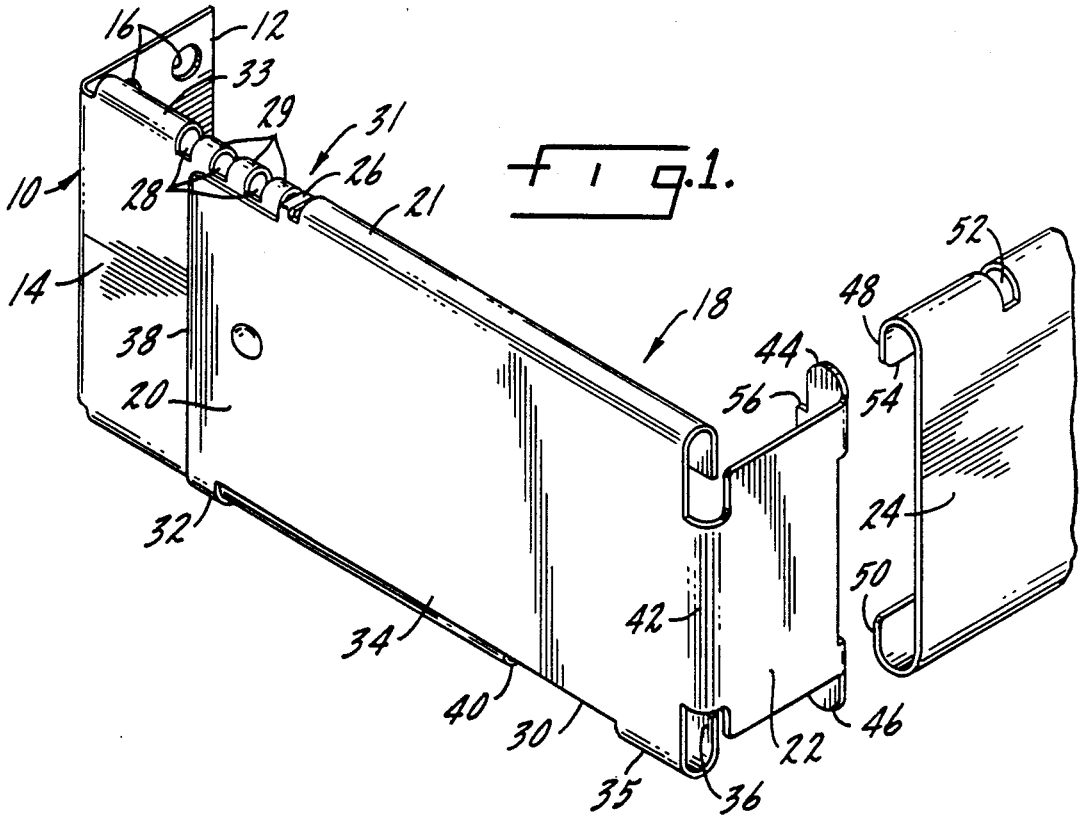
FIG. 1 is a perspective view of a curtain support system made in accordance with the present invention with the iron curtain rod shown disassembled.

FIG. 1 is a perspective view of a curtain support system in accordance with the present invention. The system includes a mounting bracket 10 which includes a mounting plate 12 and a bracket arm 14. The mounting plate 12 includes apertures 16 which provide means for attaching the bracket to a wall or window woodwork. The system shown in FIG. 1 further includes a rod connecting member 18 which is comprised of a rod arm 20 and a rod insert 22, the rod arm 20 and the rod insert 22 having planar areas which are generally perpendicular to one another. The system further includes a rod section 24, which is shaped to telescopically engage another rod section.

The arrangement shown in FIG. 1 is the left end of a curtain rod system, the right end of which would be a mirror image of the arrangement shown in FIG. 1.

Figure 5:
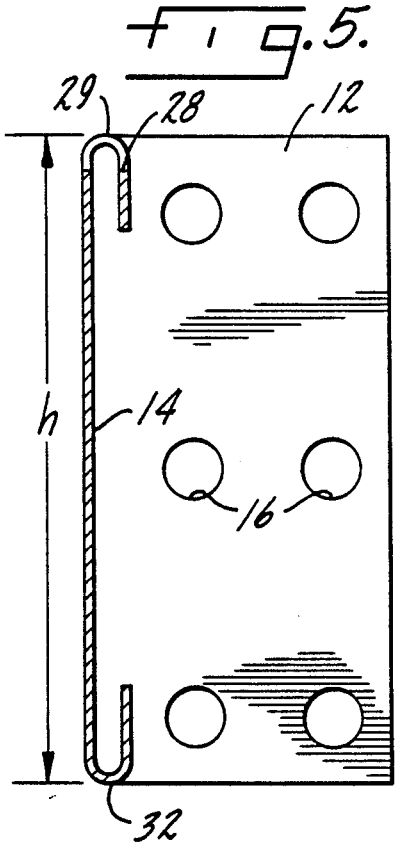
FIG. 5 is sectional view taken along line 5—5 of FIG. 4.
Figure 6:
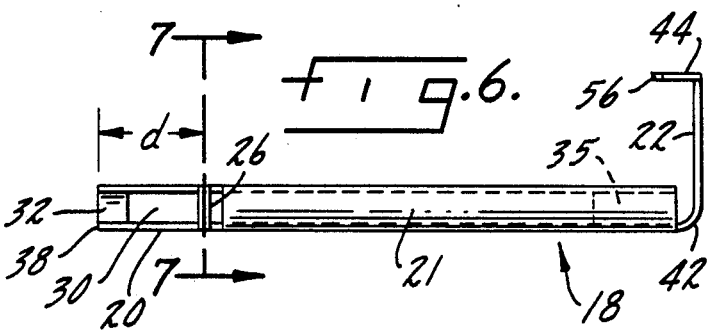
FIG. 6 is a top plan view of a rod arm made in accordance with the present invention.
Figure 7:
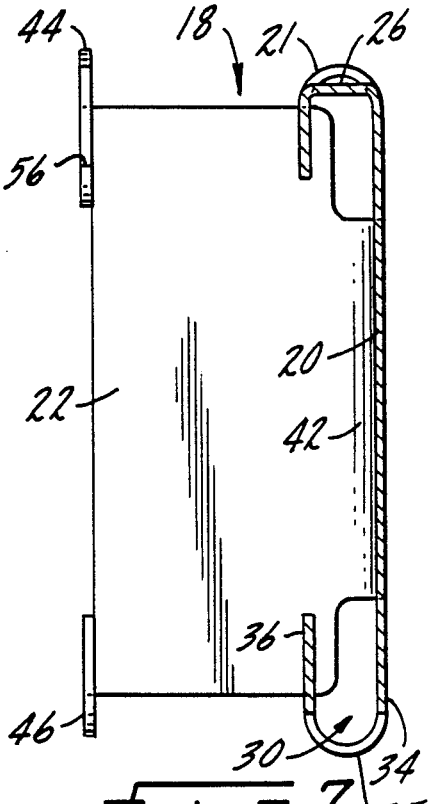
FIG. 7 is a sectional view of the rod arm taken along line 7—7 in FIG. 6.

The rod arm 20 is adjustably attached to the bracket arm 14. As can be seen from FIGS. 5 and 7, the arms 14 and 20 each have a generally C-shaped cross-section, the C-shaped cross-section of the rod arm 20 being slightly larger than the C-shaped bracket arm 14. The end view of the rod arm 20 shown in FIG. 1 shows the C-shaped configuration thereof. As shown in FIGS. 1, 2, 4 and 6, the rod arm 20 includes a tab 26 which acts as a catch to engage the plurality of slots 28 formed in the upper edge of the bracket arm 14. The slots 28 are separated by arched segments 29 which, together with the slots 28, form a rack 31 on the uppermost edge 33 of the bracket arm 14. The tab 26 is disposed downwardly from the uppermost edge 21 of the rod arm 20 so that it extends into one of the slots 28 when the arms 14 and 20 are generally parallel. The rod arm 20 includes an opening 30 which forms a cut-away section along the bottom of the rod arm 20. The opening 30 does not extend longitudinally the full length of the arm 20, but rather is between the bottom end sections 32 and 35. The opening 30 extends laterally from the lower portion of the flat outer face 34 of the rod arm 20 to the inner upwardly extending flat portion 36 which is parallel of the outer face 34. The lower outer end 40 of the bracket arm 14 can freely pass through the opening 30.

The tab 26 is located along the rod arm 20 a predetermined distance d (See FIG. 6) from the inner edge 38 of the rod arm 20. The length of the distance d is related to the height h (See FIG. 5) of the bracket arm 14, the distance d being sufficient to allow the tab 26 to rotate out of engagement with slots 28 when the rod arm 20 is rotated relative to the bracket arm 14. If the distance d is not sufficient to allow such rotation, there will be insufficient clearance between the tab 26 and the arched segments 29 as the rod arm 20 rotates about the bottom end section 32. As the height h of the rod arm is increased, the distance d should also be increased to allow for the larger radius of rotation between the arms 14 and 20. A ratio of h to d of about 2.5 to about 4.5 has been found to be effective for brackets ranging in overall nominal height from about 2.25 inches to 4.5 inches. Such ratios allow for disengagement of the tab 26 from the rack 31 without the need for large amounts of upward angular rotation of rod arms with respect to the bracket arms.

Figure 2:
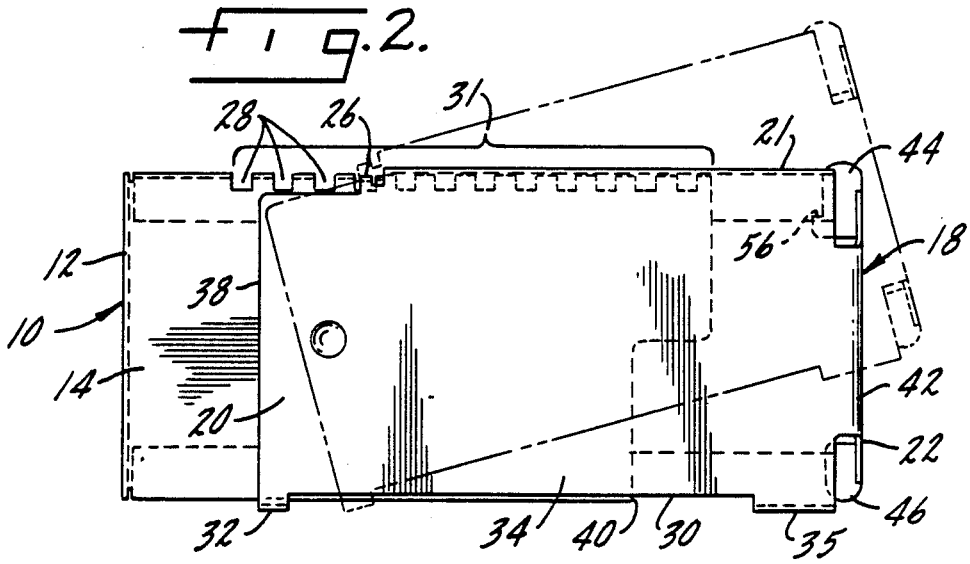
FIG. 2 is a side elevational view of a curtain support system of the present invention showing the manner in which the system may be adjusted.

FIG. 2 shows more clearly the relative positions of the arms 14 and 20 during the rotation necessary to achieve repositioning of the tab 26 into the various slots 28. It can be seen from FIG. 2 that the opening 30 must be of substantial length so that, when the tab 26 engages the inner-most one of the slots 28 (the one closest to the plate 12) the outer end 40 of the bracket arm can freely pass through the opening 30. It can also be seen from FIG. 2 that the full curved cross-section of the lower inner end 32 of the rod arm 20 acts as a stop to prevent downward rotation of the rod arm 20 past the point at which the arms are generally parallel. However, the relative positions of the tab 26 and the lower inner end 32 are such that upward rotation of the arms is possible, so that the rod arm can be translated and repositioned as desired. The tab 26 and the lower inner end 32 act as opposing bridges across the upper and lower reversely bent portions of the C-shaped cross-section of the rod arm 20. The axially offset relationship of the tab 26 and the lower inner end 32 allows the rod arm to extend in a cantilevered manner from the bracket arm as the opposing portions of the rod arm compressively engage upper and lower surfaces of the bracket arm, the upper compressive engagement being farther out along the bracket arm than the lower compressive engagement.

Figure 3:
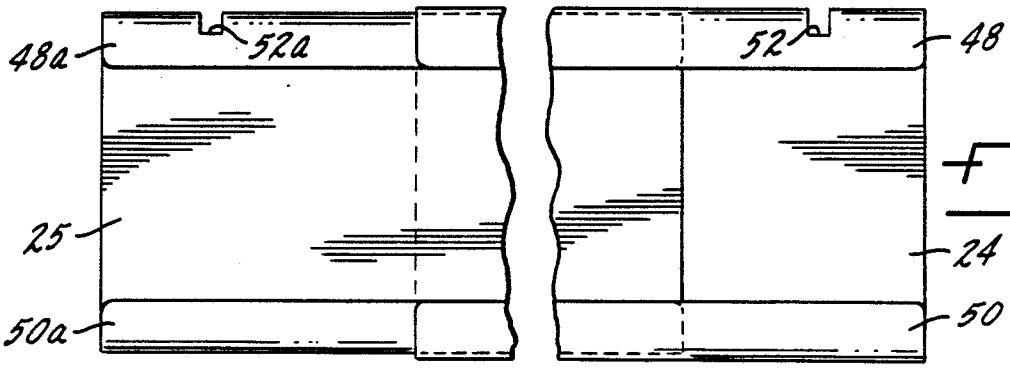
FIG. 3 is a rear elevational view of two curtain rod sections of the present invention telescopically engaged.
Figure 4:
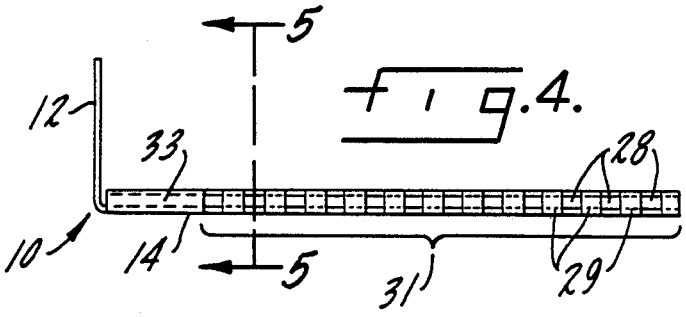
FIG. 4 is a top plan view of a bracket arm made in accordance with the present invention.
Figure 8:
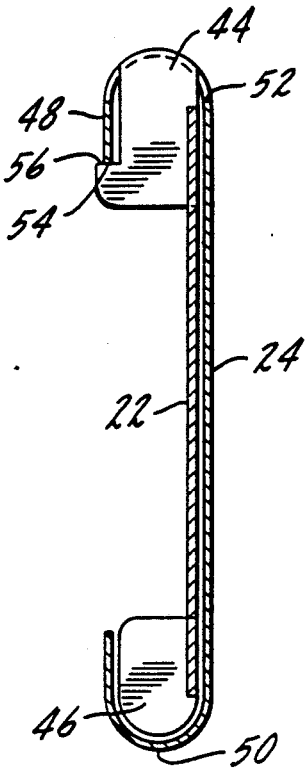
FIGS. 8 and 9 are sectional views showing the engagement between a rod insert and a rod section.
Figure 9:
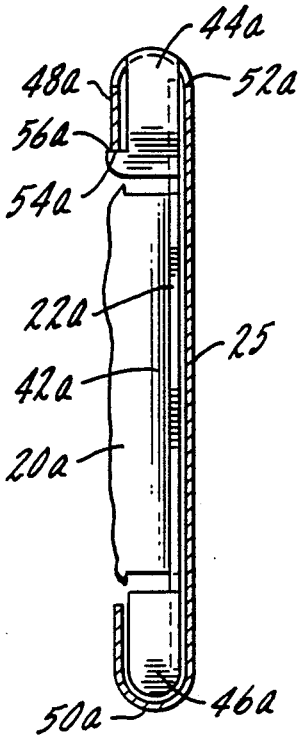

FIGS. 1 and 3 show the manner in which the main cross-members, rod sections 24 and 25, are attached to one another and to the corresponding rod inserts, only one of which (rod insert 22) is shown in the Figures. The rod insert 22 shown in FIG. 1 is integrally attached to the rod arm 20 by the connecting section 42. The rod insert 22 includes an upper finger 44 and a lower finger 46, which are shaped and spaced to closely fit within the C-shaped cross-section of the rod section 24. The reversely and inwardly bent upper and lower ends, 48 and 50 respectively, are slightly larger than the configuration defined by the upper and lower fingers 44 and 46. The upper end 48 of the rod section 24 contains a transverse slot 52 which engages the upper finger 44. When the finger 44 is in engagement with the slot 52, the upper free edge 54 of the rod section 24 rests on the shoulder 56 which is adjacent to the finger 44. This arrangement prevents the finger 44 from projecting beyond the upper surface of the rod section 24, so that curtain material can easily slide across the upper surface of the rod section 24 without interference with the finger 44. FIGS. 8 and 9 clearly show the vertical relationship between the rod sections and fingers of the present invention. The length of the rod insert 22 and the position of the slot 52 are designed so that the left end of the rod section 24 will lie just adjacent to, but will not interfere with, the rod arm 20.

The rod sections 24 and 25 are intended to be telescopically engaged so that windows of various widths can be accommodated with a curtain support system of the present invention. Such a telescopic connection requires that one of the rod sections be slightly larger than the other. As a consequence of this requirement, the corresponding rod insert and rod arm should be correspondingly dimensioned. Therefore, one rod insert (such as the one shown in FIG. 8) will be larger than the other (such as the one shown in FIG. 9). Based upon the arrangement shown in FIG. 3 in which the rod sections are viewed from the back, the rod section and rod insert shown in FIG. 8 would correspond to the left end of a curtain rod support, and would correspond to the arrangement shown in FIG. 1. The resulting right hand end arrangement of a rod insert would be slightly smaller in size, such as the one shown in FIG. 9. Only the right and left rod inserts and rod sections need to be different in size; the right and left rod arms and bracket arms be have approximately the same sized C-shaped interfitting configurations.

FIG. 9 shows a sectional view of the right hand end of a curtain support system of the present invention. The rod section 25 is smaller in size than the rod section 24 shown in FIG. 8, because of the telescopic relationship shown in FIG. 3. As a result, the upper and lower fingers **44*a* and 46*a* are similar in shape but smaller in size as compared to the fingers 44 and 46. In FIG. 9**, the designation "a" is used following references numerals which correspond to those used for similar parts in other figures.

Clearly, the rod section shown in FIGS. 1, 3 and 8 could be made to be integral with the rod arm 20 shown in FIGS. 1, 2, 6 and 7. In such an arrangement, the rod insert 22 and the upper and lower fingers 44 and 46 would be eliminated, and the connecting section 42 would directly join the rod arm 20 and the rod section 24.

While a particular embodiment of the invention has been shown and described herein, it is expected that numerous alternatives, modifications and variations of the invention will occur to those who understand the invention. It is intended that all such alternatives, modifications and variations be included within the spirit and scope of the appended claims.

I claim:

1. An adjustable curtain support comprising a wall attachable support means having wall attachment means and an outwardly extending first arm connected thereto, and a second intermediate support arm having cross-member carrying means, said first and second support arms having interconnectable adjustable means for varying the distance between said wall attachment means and said cross-member engagement means;

said adjustment means comprising a cooperating catch means and rack means, said catch being carried by one of said arms and said rack means being carried by the other of said arms.

2. An adjustable curtain support in accordance with claim 1 wherein:

said rack means comprises a plurality of slots formed in an upper surface of said wall attachable support arm, and said catch means comprises a small bar having a width which enables said bar to fit closely within any of said slots.

3. An adjustable curtain support in accordance with claim 2 wherein:

said catch means further comprises downward rotational stop means to engage said wall attachable support arm and hold said second intermediate support arm in a generally horizontal position when said bar is in one of said slots.

4. An adjustable curtain support in accordance with claim 3 wherein:

said first and second support arm have complimentary interfitting C-shaped sections, said slots and said bar being carried by upper portions of said C-shaped sections, and said stop means being carried by lower portions of said C-shaped section of said intermediate support means.

5. An adjustable curtain support in accordance with claim 4 wherein:

a major portion of a lower portion of said C-shaped section of said intermediate support arm being cutaway to allow relative rotation of said intermediate and first-wall attachable support means.

6. An adjustable curtain support system comprising a wall mountable bracket having an arm and means for attaching said bracket to a surface, a moveable bracket having means for carrying a curtain rod cross-member, said moveable bracket having an arm shaped to adjustably engage said wall mountable bracket arm, said arms having means for holding said arms at various relative axial positions, said means for holding said arms at various relative axial positions comprising a plurality of slots on one of said arms and slot engagement means on the other of said arms, said arms having complementary interfitting C-shaped cross-sectional configurations whereby one of said arms is substantially able to envelope the other of said arms such that one of said arms is an outer arm and the other of said arms is an inner arm, a first one of said arms including a plurality of slots and a second one of said arms including slot engaging means, an open section for allowing passage of a portion of said first arm through said open section upon relative rotation of said arms.

7. An adjustable curtain support system in accordance with claim 6 wherein:

said means for carrying said curtain rod cross-member is an integrally formed connecting section between said moveable bracket and said cross-member.

8. An adjustable curtain support system in accordance with claim 6 wherein:

said means for holding said arms at various relative axial positions comprises a pair of opposing bracket arm engagement members, said members being axially offset with respect to each other, said members being positioned to compressively engage upper and lower surfaces of said wall mountable bracket.

9. An adjustable curtain support system comprising a wall mountable bracket having an arm and means for attaching said bracket to a surface, a moveable bracket having means for carrying a curtain rod cross-member, said moveable bracket having an arm shaped to adjustably engage said wall mountable bracket arm, said arms having means for holding said arms at various relative axial positions, said means for carrying a curtain rod cross-member includes upper and lower tabs offset with respect to the axis of said arms.

10. An adjustable curtain support system in accordance with claim 9 wherein:

said tabs are rounded to match and fit within a C-shaped cross-member, said upper tab having a shoulder shaped to support a downwardly extending edge of said C-shaped cross-member such that said upper tab is prevented from extending through an opening in the upper surface of said cross-member.

11. An adjustable curtain support comprising:

a first wall attachable support means having wall attachment means and an outwardly extending arm connected thereto and second intermediate support means having cross-member carrying means, said first and second support means having interconnectable adjustment means for varying the distance between said wall attachment means and said cross-member engagement means, said adjustment means comprising a cooperating catch means and rack means, said catch being carried by said intermediate support means and said rack means being carried by said first wall attachable support means, said rack means comprising a plurality of slots formed in an upper surface of said first wall attachable support means, and said catch means comprising a small bar having a width which enables said bar to fit closely within any of said slots, said catch means further comprising downward rotational stop means to engage said first wall attachable support means and hold said second intermediate support means in a generally horizontal position when said bar is in one of said slots.

12. A two-piece bracket assembly for varying the perpendicular distance between the surface on which the bracket assembly is mounted and the portion of said bracket assembly which is most remote from said mounting surface, said bracket assembly including a first bracket member having a projecting portion constructed and arranged to extend generally outwardly from a mounting surface and means for securing said projecting portion to said mounting surface, a second bracket member, said second bracket member being engagable with said first bracket member and linearly moveable with respect thereto over a range of movement whereby the distance between the portion of the second bracket member most remote from the mounting surface can be varied to a desired position within the range of movement, said first and second bracket members having cooperating locking means which secure said members to one another at a desired position within said range of movement, said second bracket member being pivotable with respect to the first bracket member about a generally horizontal axis to disengage the locking means, enable change of position of the two bracket members with respect to one another within the range of movement, and re-engagement of the locking means.

13. A two-piece bracket assembly for varying the perpendicular distance between the surface on which the bracket assembly is mounted and the portion of said bracket assembly which is most remote from said mounting surface, said bracket assembly including a first rigid member having a base portion, a projecting portion, and means for securing said base portion to a mounting surface, said projecting portion being carried by and projecting outwardly from the base portion, one of the vertical edges of said projecting portion having locking means, a second rigid member engaging the projecting portion of the first rigid component and adapted to be disposed at a plurality of positions over a range of movement of the second rigid member with respect to the first rigid member, said second rigid member having engagement means which complementarily engage the underside of said projecting portion in sliding relationship, second locking means carried by the second rigid member adapted to engage the first locking means in a plurality of positions corresponding to the range of movement of the second rigid member with respect to the first rigid member, and means for pivoting the second rigid member about the engagement means to thereby disengage the first and second locking means to permit movement of the second rigid member with respect to the first rigid member over its range of movement, and to re-engage said first and second locking means.

14. The two-piece bracket assembly of claim 13 further characterized in that the second locking means is offset from the complementary engagement means in the direction of the path of linear movement of the first and second members a distance sufficient to enable the second member to be pivoted away from the first member to a position which disengages the locking means and permits the members to move through the aforesaid range of movement prior to re-engagement of the locking means.

* * * * *